US009786989B2

(12) United States Patent
Horikoshi et al.

(10) Patent No.: US 9,786,989 B2
(45) Date of Patent: Oct. 10, 2017

(54) ANTENNA AND PORTABLE ELECTRONIC INSTRUMENT FOR USE IN NEAR FIELD COMMUNICATION

(71) Applicant: LENOVO (Singapore) PTE, LTD., New Tech Park (SG)

(72) Inventors: Hideto Horikoshi, Sagamihara (JP); Hideaki Hasegawa, Tokyo (JP)

(73) Assignee: Lenovo (Singapore) PTE. LTD., New Tech Park (SG)

( * ) Notice: Subject to any disclaimer, the term of this patent is extended or adjusted under 35 U.S.C. 154(b) by 178 days.

(21) Appl. No.: 14/548,141

(22) Filed: Nov. 19, 2014

(65) Prior Publication Data

US 2015/0138025 A1 May 21, 2015

(30) Foreign Application Priority Data

Nov. 21, 2013 (JP) ..... 2013-240781

(51) Int. Cl.
*H01Q 1/24* (2006.01)
*H01Q 7/06* (2006.01)
*H01Q 1/22* (2006.01)

(52) U.S. Cl.
CPC ..... *H01Q 7/06* (2013.01); *H01Q 1/2216* (2013.01); *H01Q 1/243* (2013.01)

(58) Field of Classification Search
CPC ..... H01Q 1/243; H01Q 1/38; H01Q 9/0421; H01Q 1/44
USPC ..... 343/702, 720, 904
See application file for complete search history.

(56) References Cited

U.S. PATENT DOCUMENTS

2009/0109118 A1 4/2009 Ma et al.
2010/0309081 A1* 12/2010 Kobayashi ..... G06K 7/10316 343/788
2012/0050114 A1* 3/2012 Li ..... H01Q 1/2266 343/702
2012/0162033 A1* 6/2012 Togashi ..... H01Q 1/243 343/720
2012/0208606 A1* 8/2012 Kubo ..... G06K 19/07779 455/575.7

FOREIGN PATENT DOCUMENTS

JP 1242742 9/1998
JP 2004166176 6/2004
JP 2007524942 8/2007
JP 2011009903 1/2011
JP 2011521513 7/2011
(Continued)

*Primary Examiner* — Dameon E Levi
*Assistant Examiner* — Collin Dawkins
(74) *Attorney, Agent, or Firm* — Kunzler Law Group

(57) ABSTRACT

Disclosed is an NFC antenna that facilitates a touch operation of a portable electronic instrument. An NFC antenna includes insulating substrates and an antenna coil having a front surface pattern and a back surface pattern formed on antenna surfaces that are present on the same planes. The insulating substrates are molded into an L shape together with a magnetic sheet sandwiched therebetween. The antenna coil is also arranged in the L shape in a similar manner. When the NFC antenna is arranged at a corner of a smart phone, a coil opening faces to a position of a touch corner. NFC can be started in a short time by a touch operation using the touch corner.

20 Claims, 7 Drawing Sheets

(56) References Cited

FOREIGN PATENT DOCUMENTS

| | | | |
|---|---|---|---|
| JP | 2011-229133 | | 11/2011 |
| JP | 2012-134605 | | 7/2012 |
| JP | 4978756 | B2 | 7/2012 |
| JP | 2013222264 | | 10/2013 |

* cited by examiner

ANTENNA AND PORTABLE ELECTRONIC INSTRUMENT FOR USE IN NEAR FIELD COMMUNICATION

FIELD

The present invention relates to an antenna for performing near field communication (NFC), and more specifically, relates to an antenna for facilitating a touch operation performed by a portable electronic instrument.

BACKGROUND

RFID (Radio Frequency Identification) is known as a wireless communication technology using a contactless IC card or a contactless IC tag. NFC (Near Field Communication) is conceptually similar to RFID in that the contactless IC card is used. RFID is sometimes capable of communication at a distance of approximately a few meters, and meanwhile, NFC performs communication by bringing antennas close to each other at an approximate distance of 2 centimeters to 4 centimeters or less, and is used differently from RFID. Accordingly, separately from RFID, a standardizing body called the NFC forum has developed the technical specifications of NFC, and has prescribed the developed technical specifications as ISO/IEC14443 and ISO/IEC18092.

Among smart phones and tablet terminals in recent years, those which mount an NFC module thereon have gradually entered the stage. In NFC, there are defined: passive communication in which a reader/writer performs communication with the contactless IC card or the contactless IC tag, which does not have a power supply; and active communication in which two instruments, each including a power supply, perform communication with each other while alternately serving as initiators and targets. The NFC standard prescribes three functions, which are: a card emulation function to replace a role of the contactless IC card; a reader/writer function for capturing an NFC tag; and an inter-instrument communication (P2P) function to communicate between NFC devices.

The reader/writer function is capable of capturing four types of contactless IC cards from Type 1 to Type 4, such as Felica (registered trademark) and Mifare (registered trademark). In NFC, it is necessary to bring an NFC antenna of one instrument close to an NFC antenna of other instrument at a distance where both of the instruments are communicable with each other. However, the reader/writer function is capable of reading and writing data from and to the contactless IC card that does not have a power supply by accessing the contactless IC card concerned, and is capable of starting and ending the communication by only bringing both of the instruments close to each other. Therefore, in the smart phone or the tablet terminal, which can be held by one hand, the reader/writer function is used in a variety of fields such as a smart poster and electronic payment.

SUMMARY

In a case of performing NFC between the portable electronic instrument such as the smart phone and the tablet terminal and a standstill electronic instrument such as a reader/writer at a ticket barrier, a computer and a printer, an operation of bringing the hand-held portable electronic instrument close to the antenna of the standstill electronic instrument is performed. Hereinafter, such an NFC-oriented operation of bringing one instrument held by hand close to other instrument and electromagnetically coupling the antennas thereof to each other is referred to as a touch operation. Heretofore, in the portable electronic instrument, a front surface thereof, which serves as an operation surface, or a back surface thereof opposite with the front surface has been brought close to the antenna of the other party, whereby the touch operation has been performed.

FIG. 7 shows a state when the touch operation is performed by a conventional smart phone 1. It is difficult to find a position of an NFC antenna 3 in the smart phone 1. Accordingly, in order to perform the touch operation, a user must search for a position, at which NFC can be started, by holding a side surface of a chassis of the smart phone 1 and moving a front surface or back surface of the chassis while bringing the front surface or the back surface close to the antenna on such other party side. Hence, in some case, it takes long to make such a search performed until NFC is started, and this occurs more frequently in a tablet terminal with a large area. Moreover, in order to bring the front surface or the back surface close to the antenna on the other party side, it is necessary to hold the smart phone 1 by sandwiching only the side surface of the chassis thereof between fingers so that the fingers cannot reach the front surface of the chassis. In this case, it is difficult to hold the chassis, and accordingly, there is also a risk that the smart phone 1 may fall down.

Moreover, in a case of using a metal material such as aluminum and magnesium for the back surface of the chassis of the electronic instrument, the back surface cannot be used as a touch surface since an eddy current inhibits passage of a magnetic flux. Even in a method of providing a plurality of antennas, it takes a time to make such a position search for performing NFC since the user does not know an accurate position of the antenna in the cellular phone. Furthermore, wires from an NFC module to the antenna are increased, and this increase inhibits enhancement of a packaging density.

In some current methods, though NFC can be performed by bringing a corner, which is formed of a front surface or back surface of a chassis of a wireless terminal and of a side surface thereof, close to the antenna on the other party side, it takes a time to make the position search performed until NFC is started since the user does not know the accurate position of the antenna unless providing the antenna all over the side surface. Moreover, since the antenna surface is bent, the chassis cannot be thinned.

A first aspect of the present embodiments provides an antenna, which is housed in a chassis of a portable electronic instrument and is used for near field communication. An antenna surface of an insulating substrate is provided with a bent portion bent at a predetermined angle on a same plane. A loop-like antenna coil includes a coil pattern formed on the antenna surface so as to be bent at the predetermined angle, and is provided with an inlet/outlet port of a crossing magnetic flux on a side surface including the bent portion of the insulating substrate. The bent insulating substrate can be molded by processing a flat single insulating substrate and coupling two types of insulating substrates to each other.

The antenna has the inlet/outlet of the crossing magnetic flux on the side surface of the insulating substrate, and accordingly, can be arranged at an end of the portable electronic instrument so that the inlet/outlet can face to a side surface of the chassis of the portable electronic instrument. Hence, the antenna is suitable for thinning the chassis of the portable electronic instrument and performing high-density packaging for the portable electronic instrument. The predetermined angle of the insulating substrate can be matched with an inner side surface of the portable electronic instrument; however, can be fitted to many portable electronic instruments, in each of which a chassis has a rectangular parallelepiped shape, if the predetermined angle is set at 90 degrees. Note that the bent portions of the insulating substrate and the antenna may be bent sharply or may be bent gently.

The coil opening of the antenna coil, through which the crossing magnetic flux passes, can be formed on the side surface of the insulating substrate. At this time, the coil pattern can be composed by including: a front surface pattern formed on a front surface of the insulating substrate; and a back surface pattern formed on a back surface of the insulating substrate and connecting to the front surface pattern at an end portion thereof. By using the back surface pattern, the number of turns of the antenna coil can be increased with respect to a predetermined area of each of the antenna surfaces. Furthermore, at this time, the insulating substrate can include a first insulating substrate and a second insulating substrate, which sandwich a magnetic sheet therebetween, in which the front surface pattern can be formed on the first insulating substrate, and the back surface pattern can be formed on the second insulating substrate.

A coil opening of the antenna coil, through which a crossing magnetic flux passes, can be formed on the antenna surface of the insulating substrate. At this time, a magnetic sheet that guides the crossing magnetic flux from the side surface of the insulating substrate to the coil opening can be provided. In a case where the coil pattern includes an inner pattern and an outer pattern, which are opposite to each other about the coil opening, the magnetic sheet can be arranged so as to penetrate the coil opening and so that a projection thereof can overlap the inner pattern and the outer pattern.

A second aspect of the present embodiments provides a portable electronic instrument capable of performing near field communication. A chassis of the portable electronic instrument includes a side surface, a front surface and a back surface, and defines a touch corner for performing a touch operation at a corner of the side surface. An antenna of the portable electronic instrument includes an insulating substrate in which an antenna surface is bent at a predetermined angle fitted to the corner of the side surface on a same plane, and a loop-like coil pattern provided with an inlet/outlet port of a crossing magnetic flux on a side surface of the insulating substrate and formed on the antenna surface so as to be bent at a predetermined angle, in which the inlet/outlet port of the crossing magnetic flux is arranged so as to face to the side surface side of the chassis.

The touch corner of which position is easily recognizable owing to a structure of the chassis serves as the inlet/outlet port of the crossing magnetic flux. Accordingly, the touch corner is brought close to an antenna on other party, whereby NFC can be started in a short time. Moreover, in a case of directing the touch corner to the antenna on the other party, it becomes easy to hold the portable electronic instrument. In a vicinity of the touch corner, a shock absorbing region that absorbs a shock of the touch operation can be formed. If the antenna surface is arranged in parallel to the front surface of the chassis, then a space used by the antenna in a thickness direction of the chassis can be reduced. Since the side surface of the chassis serves as the inlet/outlet port of the magnetic flux, the back surface of the chassis can be formed of a metal material. The portable electronic instrument can be a smart phone or a tablet terminal.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, embodiments of the invention will be described and explained with additional specificity and detail through the use of the accompanying drawings, in which.

DETAILED DESCRIPTION

Figure 1A:
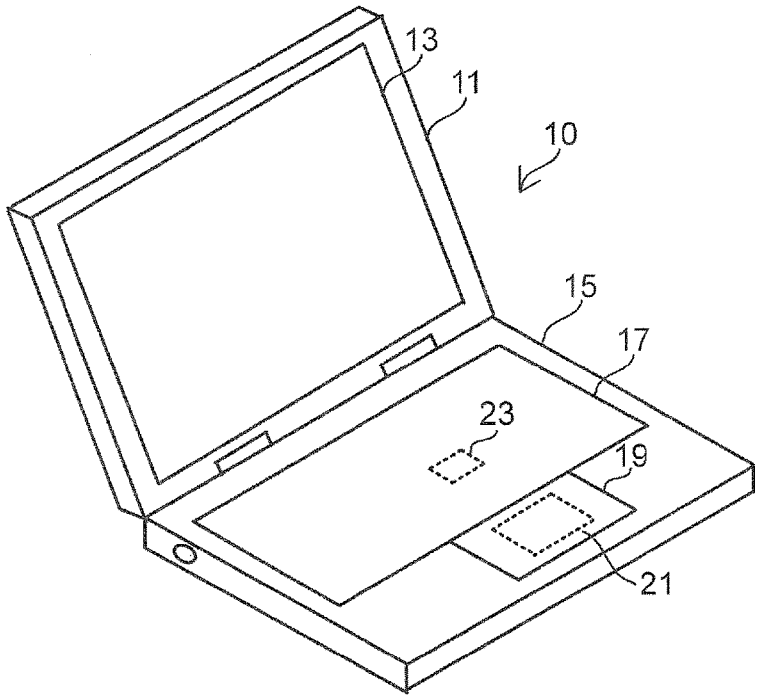
FIG. 1A and FIG. 1B are views for explaining a contour of a laptop PC 10 that mounts an NFC device thereon.
Figure 1B:
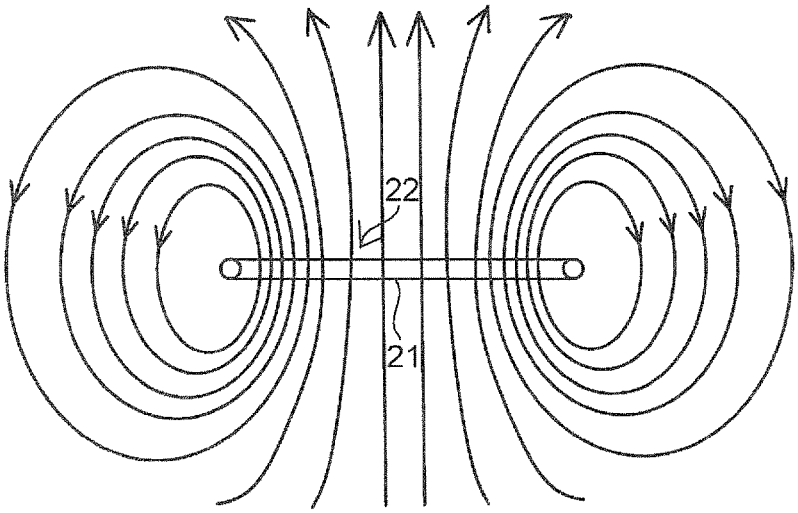
Figure 2A:
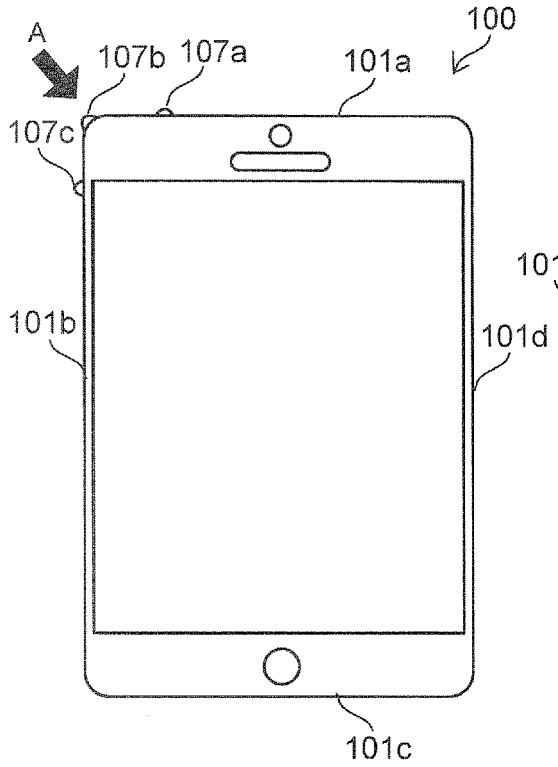
FIGS. 2A to 2D are views for explaining a contour of a smart phone 100.
Figure 2B:
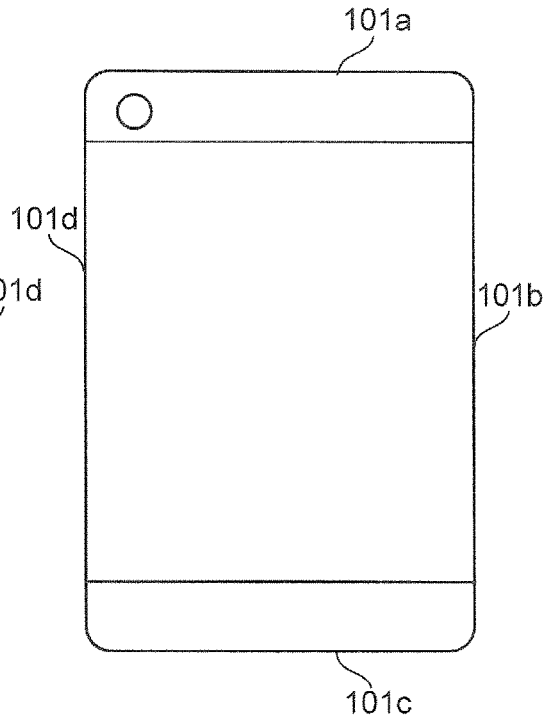
Figure 2C:
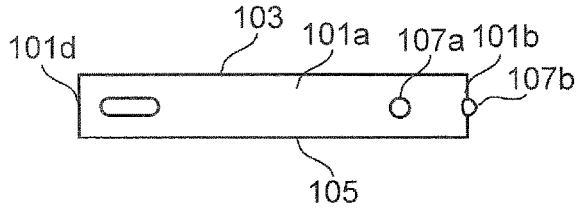
Figure 2D:
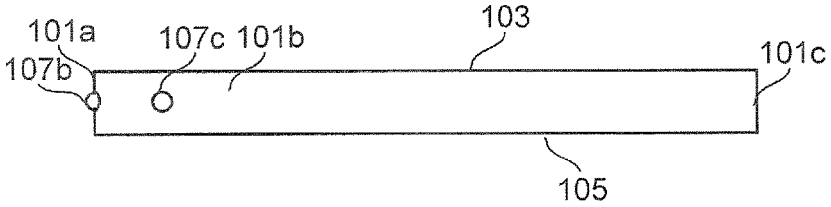

FIGS. 1A and 1B are views for explaining a contour of a laptop PC 10 that mounts an NFC device thereon. As shown in FIG. 1A, in the laptop PC 10, a display chassis 11 that mounts an LCD 13 thereon and a system chassis 15 that mounts a keyboard 17 and a touchpad 19 on a surface thereof and houses a circuit board therein are coupled to each other so as to be openable and closable. Here, the circuit board packages a system device in an inside thereof. An NFC antenna 21 formed of a loop coil is arranged under the touchpad 19. The circuit board housed by the system chassis 15 packages therein an NFC module 23 connected to the NFC antenna 21.

FIG. 1B shows a state of a magnetic field formed on a front surface of the touchpad 19 by the NFC antenna 21. When a high frequency current flows through the NFC antenna 21, an alternating magnetic field that passes through coil openings 22 are formed, and an alternating magnetic flux corresponding to a magnetic permeability flows through an ambient space. On the contrary, when an external alternating magnetic flux passes through the coil opening 22 and crosses the NFC antenna 21, a high frequency voltage is induced in the NFC antenna 21, and a high frequency current corresponding to an impedance flows.

FIGS. 2A to 2D are views for explaining a contour of a smart phone 100 capable of performing NFC with the laptop PC 10. FIGS. 2A to 2D are a plan view, a bottom view, a rear view and a left side view, respectively. The smart phone 100 defines the contour thereof by a front surface 103, a back surface 105 and external side surfaces 101*a* to 101*d*. A corner shown by an arrow A, where the side surface 101*a* and the side surface 101*b* connect to each other, corresponds to a central spot on which the smart phone 100 performs a touch operation. Hereinafter, this corner is referred to as a touch corner A. In an inside of the touch corner A, an NFC antenna 200 (FIGS. 3A to 3C) of the smart phone 100 is arranged as will be described later.

The front surface 103 can be formed of a glass plate, and the back surface 105 and the side surfaces 101*a* to 101*d* can be formed of synthetic resin. However, among the back surface 105 and the side surfaces 101*a* to 101*d*, a region in a vicinity of the touch corner A, the region excluding a region to which the NFC antenna 200 is attached, can be formed of a metal material such as magnesium and aluminum. On the touch corner A and the side surfaces 101*a* and 101*b* in the vicinity thereof, shock absorbing protrusions 107*a* to 107*c* are provided, which are formed of an elastic member such as rubber and springs in order to absorb a shock when the touch operation is performed for the touch panel 19.

Figure 3A:
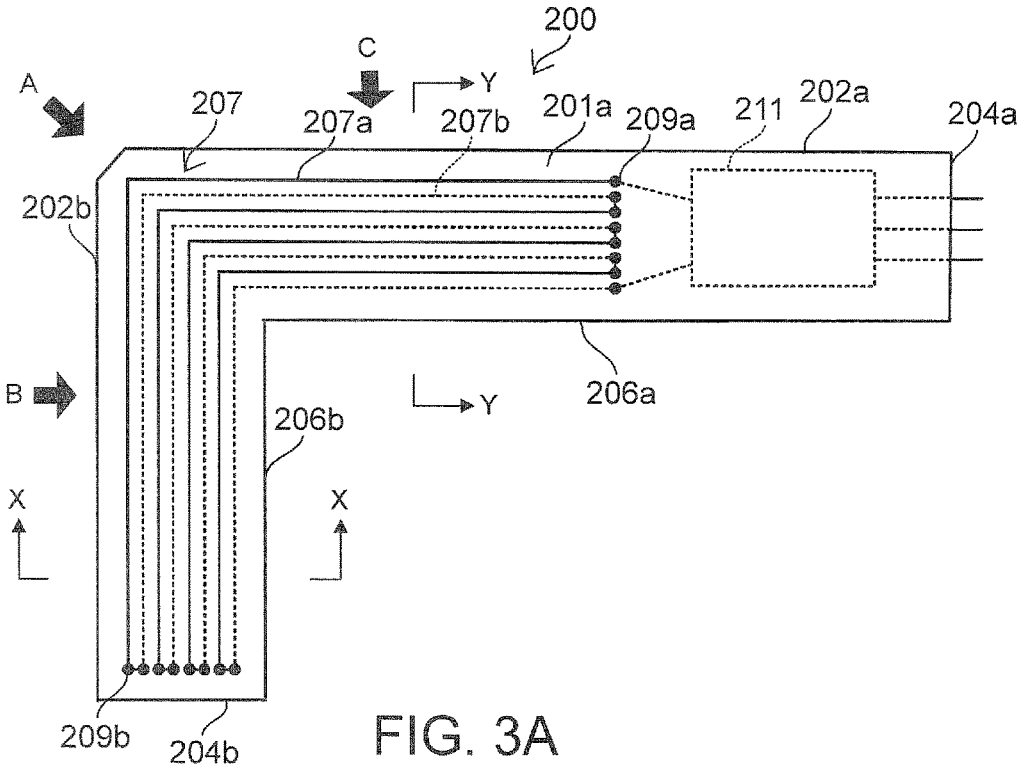
FIGS. 3A to 3C are views for explaining a structure of an NFC antenna 200.
Figure 3B:
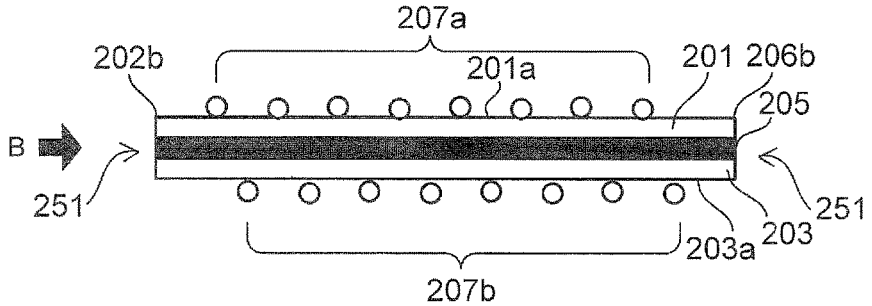
Figure 3C:
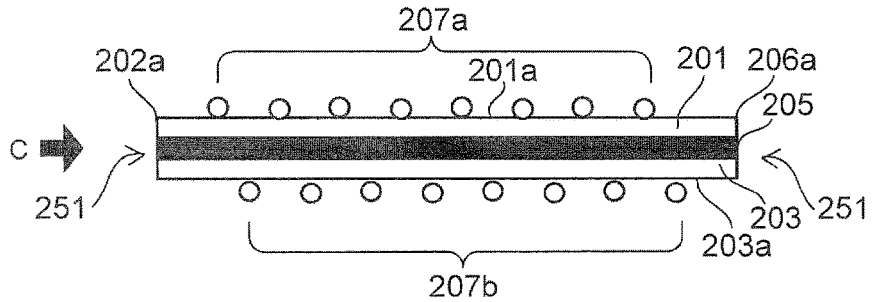

FIGS. 3A to 3C are views for explaining a structure of the NFC antenna 200 packaged in the smart phone 100. FIG. 3A is a plan view, and FIGS. 3B and 3C are cross-sectional views cut along lines X-X and Y-Y of FIG. 3A, respectively. The NFC antenna 200 includes an antenna coil 207 formed on front surfaces of a front-side insulating substrate 201 and a back-side insulating substrate 203. The insulating substrates 201 and 203 may be either rigid substrates such as glass epoxy substrates and composite substrates or flexible substrates such as polyimide films and polyester films. It is not necessary to particularly limit a pattern forming method, and it is possible to adopt a variety of methods such as etching of copper foil pasted onto entire surfaces of the insulating substrates 201 and 203 and copper plating for the insulating substrates 201 and 203 on each of which a resist is formed.

A magnetic sheet 205 formed of a ferromagnetic material such as ferrite powder and metal powder is sandwiched between the insulating substrate 201 and the insulating substrate 203. The antenna coil 207 includes a front surface pattern 207*a* and a back surface pattern 207*b*. The front surface pattern 207*a* is formed on the insulating substrate 201, and the back surface pattern 207*b* is formed on the insulating substrate 203. The front surface pattern 207*a* and the back surface pattern 207*b* electrically connect to each other at end portions thereof by through holes (via holes) 209*a* and 209*b*, of which insides are plated, so that an entirety of the antenna coil 207 can be a single continuous lead wire to form the loop coil.

Hereinafter, the front surfaces of the insulating substrates 201 and 203 on which the front surface pattern 207*a* and the back surface pattern 207*b* are formed are referred to as antenna surfaces 201*a* and 203*a*. In FIGS. 3A to 3C, the front surface pattern 207*a* and the back surface pattern 207*b* are arranged at positions where projections thereof are shifted from each other when viewed from the above. However, if both of the patterns are formed at positions where the projections thereof overlap each other when viewed from the above, then the number of turns of the antenna coil 207 on a predetermined area of each of the antenna surfaces can be further increased.

The insulating substrates 201 and 203 and the magnetic sheet 205 are formed into an L shape so as to be bent at a right angle at a portion shown by the arrow A while maintaining the antenna surfaces 201*a* and 203*a* individually on the same planes. The front surface pattern 207*a* and the back surface pattern 207*b* are also formed into an L shape along that the insulating substrates 201 and 203 and the magnetic sheet 205 are formed into the L shape. Outer long sides 202*a* and 202*b* and inner long sides 206*a* and 206*b* and short sides 204*a* and 204*b*, which are formed by cross sections of the insulating substrates 201 and 203 and the magnetic sheet 205, define a planar shape of the NFC antenna 200. Note that, with regard to the NFC antenna 200, in order that the touch operation can be performed at the touch corner A when the NFC antenna 200 is mounted on the smart phone 100, it is important that the outer long sides 202*a* and 202*b* be bent into the L shape, and that the antenna coil 207 be bent into the L shape along that the outer long sides 202*a* and 202*b* are bent into the L shape. It is not always necessary to form the inner long sides 206*a* and 206*b* into the L shape.

Both ends of the antenna coil 207 connect to a resonant circuit 211 packaged on the insulating substrate 203. The resonant circuit 211 is composed of a resistor, a capacitor, and a reactor, and resonates the antenna coil 207 at a high frequency current of 13.56 MHz as an example. The resonant circuit 211 connects to an NFC module 155 (FIGS. 4A and 4B) packaged on a circuit board of the smart phone 100.

The NFC antenna 200 includes inlet/outlet ports of a flux linkage in side surface directions of the insulating substrates 201 and 203 and the magnetic sheet 205, which are shown by the arrows A, B and C. The inlet/outlet ports of the flux linkage correspond to coil openings 251 of the antenna coil 207. The coil openings 251 are passages of an alternating magnetic flux crossing the antenna coil 207, and correspond to the cross sections of the insulating substrates 201 and 203 and the magnetic sheet 205. The direction of the arrow A matches with a position of the touch corner A in FIG. 2A when the NFC antenna 200 is packaged in the smart phone 100.

An induced voltage is generated when the alternating magnetic field radiated by the NFC antenna 21 of the laptop PC 10 passes through the coil openings 251 and crosses the antenna coil 207. The magnetic sheet 205 loaded into the coil openings 251 increases a magnetic flux density obtained by the alternating magnetic field radiated by the NFC antenna 21, and raises the induced voltage. On the contrary, when a high frequency current is flown through the NFC antenna 200, the antenna coil 207 radiates an alternating magnetic field, and generates an induced voltage in the NFC antenna 21. If lengths of the front surface pattern 207*a* and the back surface pattern 207*b* on the long side 202*a* side and the long side 202*b* side are equalized with each other, then a lengthwise center of the slim coil openings 251 matches with the position of the arrow A, and accordingly, such an external magnetic flux can be detected effectively in an event of the touch operation.

Figure 4A:
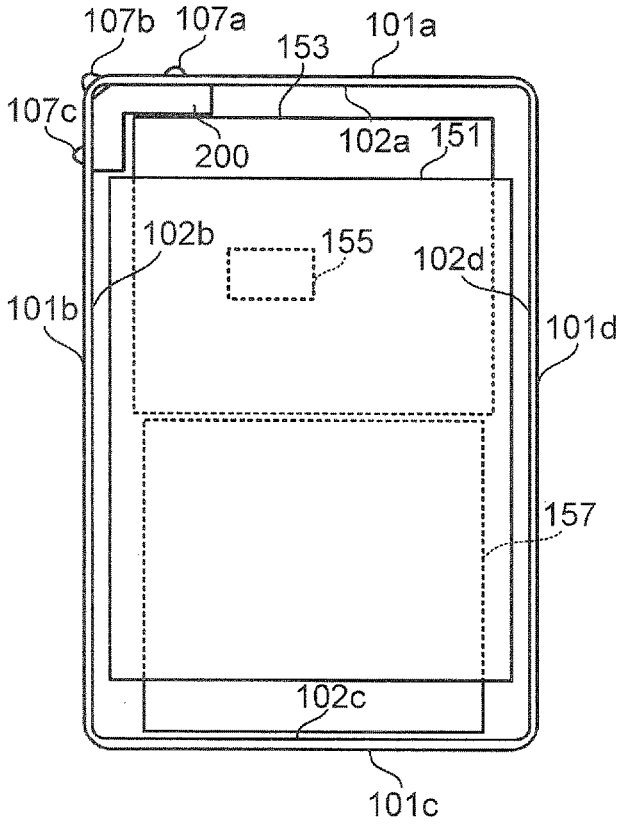
FIGS. 4A and 4B are views for explaining a state that the NFC antenna 200 is packaged in the smart phone 100.
Figure 4B:
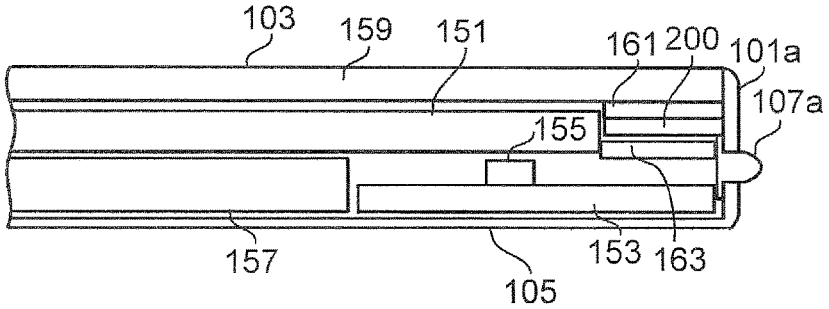

FIGS. 4A and 4B are views for explaining a state that the NFC antenna 200 is packaged in the smart phone 100. FIG. 4A is a plan view of a state that a glass plate 159 and a decorative panel 161 are removed from the smart phone 100, and FIG. 4B is a partial cross-sectional view of the smart phone 100. In an inside of the chassis in which a planar internal region is defined by inner side surfaces 102*a* to 102*d*, there are packaged: a battery 157; a circuit board 153; an LCD 151; the NFC antenna 200; and the glass plate 159. A front surface of the glass plate 159 corresponds to the front surface 103 of the smart phone 100. On the circuit board 153, a variety of electronic circuits such as a CPU, a system memory, an I/O module and a camera module are packaged as well as the NFC module 155.

The NFC module 155 is a semiconductor chip for encoding data received from the system at a transmission time, modulating a carrier wave with a frequency as high as 13.56 MHz by the encoded data, amplifying a signal obtained by such modulation, and then flowing the high frequency current through the NFC antenna 200. The NFC module 155 demodulates the data after amplifying a current obtained by the induced voltage of the NFC antenna 200, which is generated by the touch operation at a reception time, decodes the demodulated data, and sends the decoded data to the system. The smart phone 100 can perform NFC no matter whether the smart phone 100 may be a reader/writer or an IC card.

The NFC antenna 200 can be mounted onto a lower surface of the decorative panel 161 arranged under the glass plate 159 by being pasted thereonto by a double-sided tape, an adhesive or the like. Between the NFC antenna 200 and the circuit board 153, an aluminum sheet 163 is arranged in order to prevent entrance of noise into the circuit board 153 owing to the magnetic field. With regard to the NFC antenna 200, the long sides 202*a* and 202*b* (FIG. 3A) thereof are arranged in contact with or along the side surfaces 102*a* and 102*b* while being slightly apart therefrom.

The coil opening 251 faces to the side surface of the chassis of the smart phone 100, and accordingly, a back surface of the chassis can be formed of the metal material. At this time, the NFC antenna 200 can be arranged so that the antenna surfaces 201*a* and 203*a* can be parallel to the front surface 103 of the chassis. The antenna surfaces 201*a* and 203*a* are arranged in parallel to the front surface 103, whereby the NFC antenna 200 can be packaged while preventing much space being spent in an up-and-down direction of the chassis. Moreover, the NFC antenna 200 can be arranged on an end portion of the chassis, and accordingly, a packaging density of the devices in the inside of the chassis can be enhanced.

Figure 5A:
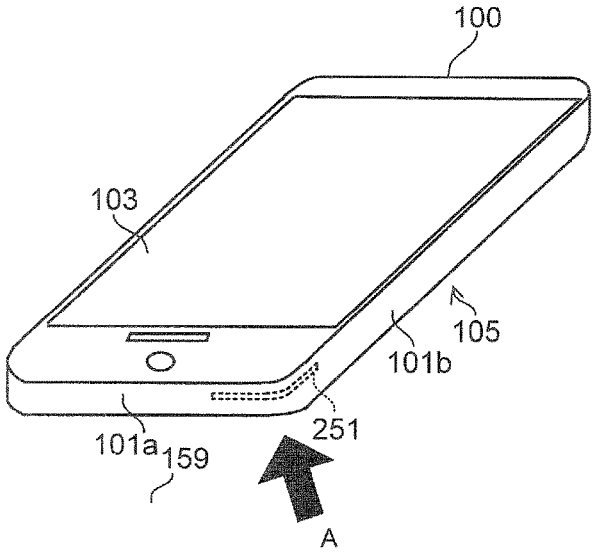
FIGS. 5A and 5B are views showing a state when the smart phone 100 that packages the NFC antenna 200 therein is brought close to a touchpad 19 and a touch operation is performed.
Figure 5B:
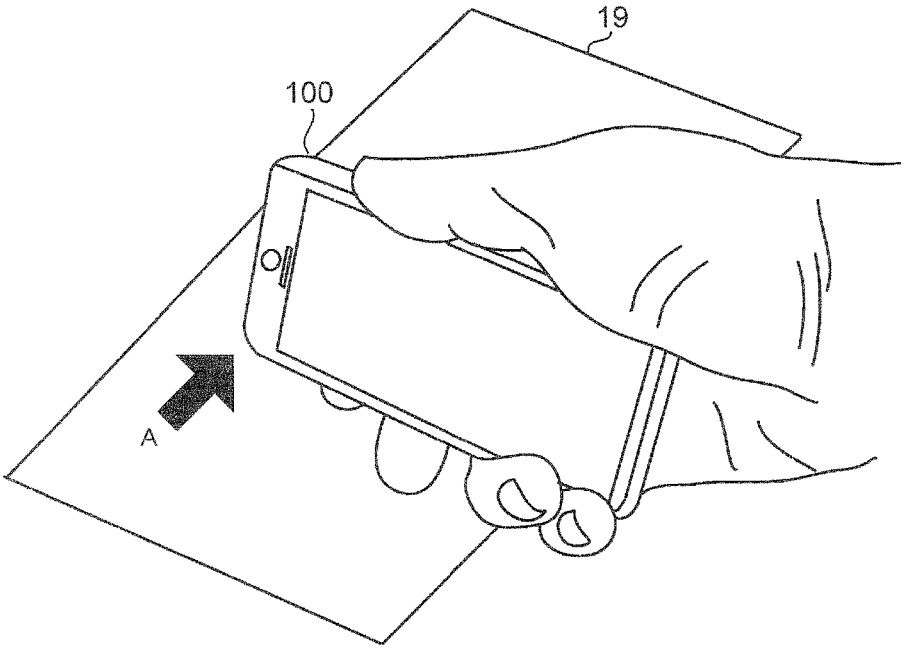

FIGS. 5A and 5B are views showing a state when the smart phone 100 that packages the NFC antenna 200 therein is brought close to the touchpad 19 and the touch operation is performed. A user can bring the touch corner A close to the touchpad 19 while surely holding the smart phone 100 by bringing the back surface 105 of the chassis of the smart phone 100 into intimate contact with the palm and turning the fingers to reach the front surface 103.

The coil openings 251 corresponding to the inlet/outlet ports of the crossing magnetic flux are present at the touch corner A that is a characteristic position of the chassis. Accordingly, the user can easily recognize the position of the touch corner A. The touch corner A is located at the center of the coil openings 251, and accordingly, the magnetic flux can be crossed efficiently by bringing the touch corner A close to the touchpad 19. When the touch corner A is brought close to a vicinity of a center of the touchpad 19, the alternating magnetic field radiated by the NFC antenna 21 induces an induced voltage with a predetermined value or more in the antenna coil 207, and it is made possible to perform NFC.

Figure 6A:
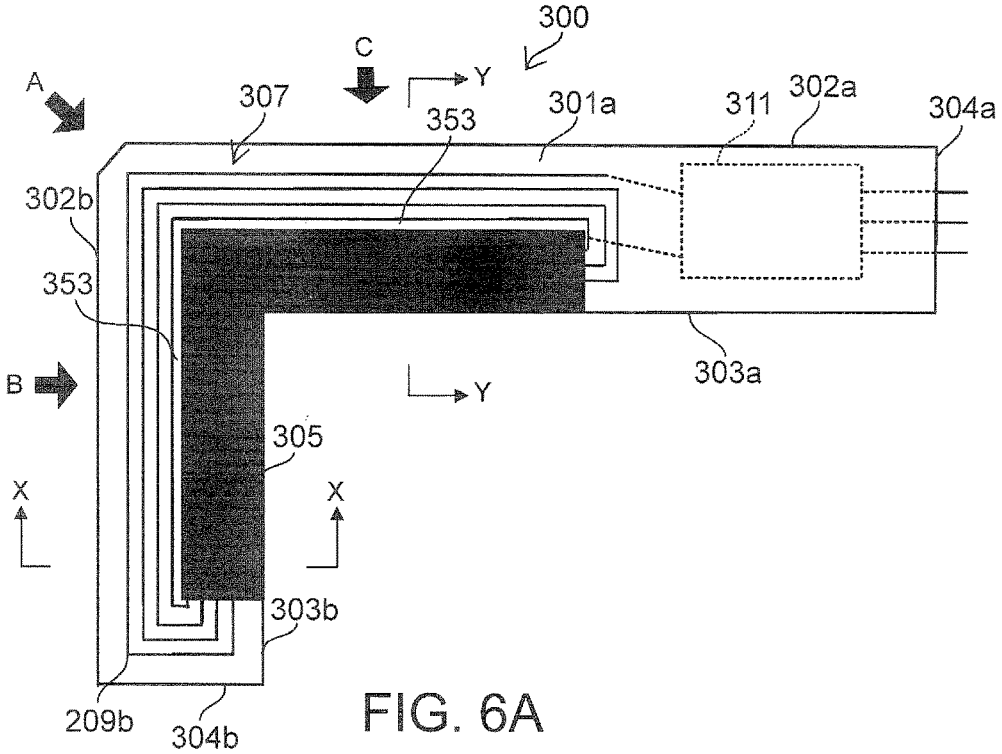
FIGS. 6A to 6C are views for explaining a structure of another NFC antenna 300.
Figure 6B:
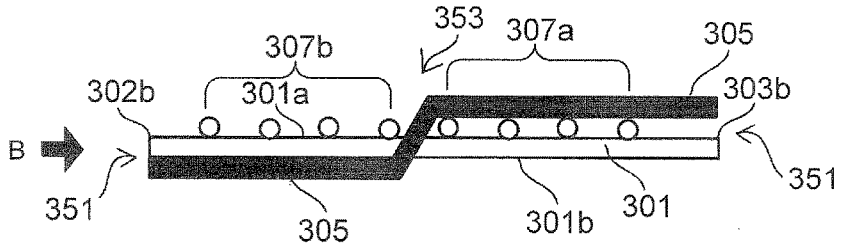
Figure 6C:
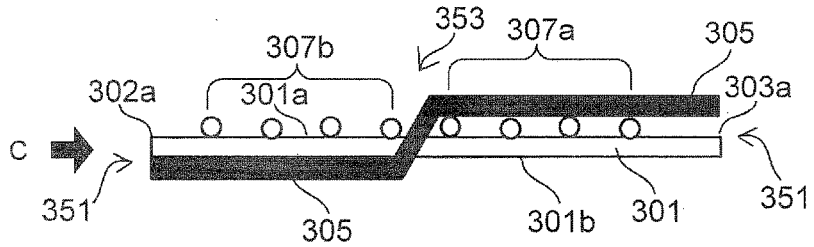
Figure 7:
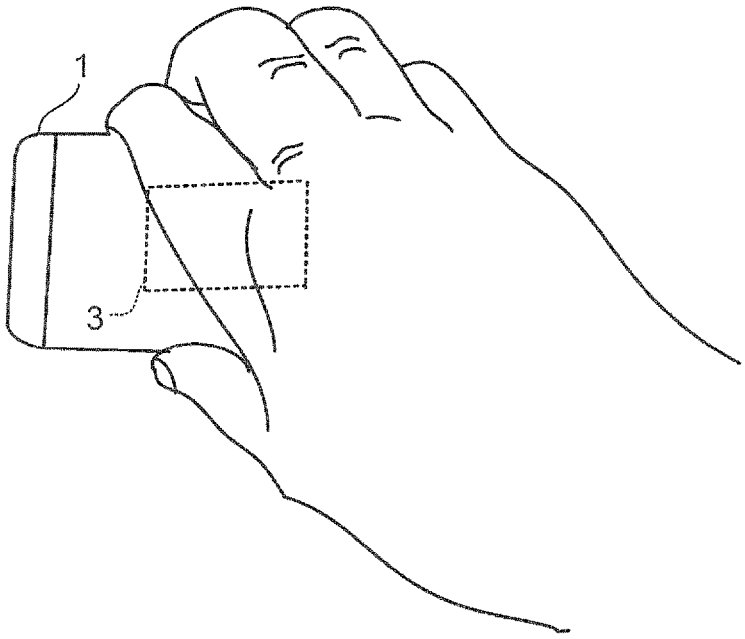
FIG. 7 is a view for explaining a state when the touch operation is performed by a conventional smart phone.

FIGS. 6A to 6C are views for explaining a structure of another NFC antenna 300 that can be arranged in the smart phone 100 in a similar way to the NFC 200. FIG. 6A is a plan view, and FIGS. 6B and 6C are cross-sectional views cut along lines X-X and Y-Y of FIG. 6A, respectively. The NFC antenna 300 forms an antenna coil 307 on an antenna surface 301*a* that is a front surface of an insulating substrate 301. A material of the insulating substrate 301 and a forming method of the antenna coil 307 can be set in a similar way to the NFC antenna 200.

The antenna coil 307 is formed on the antenna surface 301*a* so that an entirety thereof can be a single continuous lead wire to form a loop coil. A surface of the insulating substrate 301, which is opposite with the antenna surface 301*a*, is referred to as a back surface 301*b*. The insulating substrate 301 is formed into an L shape so as to be bent at a right angle at a portion shown by an arrow A while maintaining the antenna surface 301*a* on the same plane. The antenna coil 307 is also formed into an L shape along that the insulating substrate 301 is formed into the L shape. Outer long sides 302*a* and 302*b* and inner long sides 303*a* and 303*b* and short sides 304*a* and 304*b*, which are formed by cross sections of the insulating substrate 301, define a planar shape of the NFC antenna 300.

In the NFC antenna 300, a magnetic sheet 305 penetrates a coil opening 353 of the antenna coil 307. The magnetic sheet 305 includes an outer pattern 307*b* located on a long side 302*a* and 302*b* side on the outside, and an inner pattern 307*a* located on a long side 303*a* and 303*b* side in the inside. Here, the outer pattern 307*b* and the inner pattern 307*a* are opposed to each other while sandwiching the coil opening 351 therebetween. At a time of packaging the NFC antenna 300 in the smart phone 100, the inner pattern 307*a* is arranged in a direction of an inside of a chassis, and the outer pattern 307*b* is arranged in a direction of the side surfaces 102*a* and 102*b* of the chassis.

A projection of the magnetic sheet 305 overlaps the coil patterns 307*a* and 307*b*, and the magnetic sheet 305 is extended from above the coil pattern 307*a* toward the back surface 301*b* of the insulating substrate 301, which is located below the coil pattern 307*b*. Both ends of the antenna coil 307 connect to a resonant circuit 311 packaged on the back surface 301*b* of the insulating substrate 301. A direction of the arrow A matches with the position of the touch corner A of FIG. 2 when the NFC antenna 300 is packaged in the smart phone 100.

An alternating magnetic field present in a vicinity of the NFC antenna 300 generates an intense alternating magnetic flux in the magnetic sheet 305. The alternating magnetic flux that has passed through the magnetic sheet 305 penetrating the coil opening 353 crosses the antenna coil 307 and induces an induced voltage. On the contrary, when a high frequency current is flown through the NFC antenna 300, the antenna coil 307 radiates an alternating magnetic field, and induces an induced voltage in the NFC antenna 21. The NFC antennas 200 and 300 can be mounted not only on the portable electronic instrument such as the smart phone and the tablet terminal but also on other fixed-type electronic instrument. Moreover, the angle at which the insulating substrate and the coil pattern are bent can be matched with an angle of a corner of a chassis of the electronic instrument. Moreover, a bent portion of the insulating substrate may be bent not only sharply but also gently.

The description has been made above of the present invention by using the specific embodiments shown in the drawings. However, it is needless to say that the present invention is not limited to the embodiments shown in the drawings, and that any configuration known heretofore is adoptable as long as the effects of the present invention are exerted.

What is claimed is:

1. An antenna, comprising:

an insulating substrate provided with a bent portion that is bent at a predetermined angle on a same plane;

an antenna coil formed on the insulating substrate, the antenna coil comprising a first pattern formed on a first surface of the insulating substrate and bent at the predetermined angle and a second pattern formed on a second surface of the insulating substrate and bent at the predetermined angle, the antenna coil being provided with an inlet/outlet port of a crossing magnetic flux on a surface of an outer side of the insulating substrate; and a magnetic sheet that guides the crossing magnetic flux from the surface of the outer side of the insulating substrate, the inlet/outlet port being orthogonal to a plane of the magnetic sheet, wherein the magnetic sheet is located between the first pattern of the antenna coil and the second pattern of the antenna coil, wherein the first pattern is located above the plane of the magnetic sheet and the second pattern is located below the plane of the magnetic sheet.

2. The antenna of claim 1, wherein the predetermined angle is 90 degrees.

3. The antenna of claim 1, further comprising a coil opening of the antenna coil provided on the surface of the outer side of the insulating substrate, the coil opening allowing a crossing magnetic flux to pass therethrough.

4. The antenna of claim 1, wherein the first pattern formed on the first surface of the insulating substrate includes a front surface pattern formed on a front-side antenna surface of the insulating substrate and wherein the second pattern formed on the second surface of the insulating substrate includes a back surface pattern formed on a back-side antenna surface of the insulating substrate and connecting to the front surface pattern at an end portion of the back surface pattern.

5. The antenna of claim 4, wherein the insulating substrate includes a first insulating substrate and a second insulating substrate, the first and second insulating substrates sandwiching the magnetic sheet therebetween, in which the front surface pattern is formed on the first insulating substrate, and the back surface pattern is formed on the second insulating substrate.

6. The antenna of claim 1, further comprising a coil opening of the antenna coil provided on an antenna surface of the insulating substrate, the coil opening allowing a crossing magnetic flux to pass therethrough.

7. The antenna of claim 6, wherein:

the first pattern formed on the first surface of the insulating substrate includes an inner pattern formed on the antenna surface and wherein the second pattern formed on the second surface of the insulating substrate includes an outer pattern formed on the antenna surface, the inner and outer patterns being opposite to each other about the coil opening, wherein the magnetic sheet located between the first pattern and the second pattern is arranged so as to penetrate the coil opening and so that a first portion of the magnetic sheet overlaps the inner pattern and a second portion of the magnetic sheet overlaps the outer pattern, and wherein the magnetic sheet guides the crossing magnetic flux from the outer side surface of the insulating substrate to the coil opening.

8. The antenna of claim 1, wherein the antenna is housed in a chassis of a portable electronic instrument and is used for near field communication.

9. The antenna of claim 1, further comprising a coil opening of the antenna coil, the coil opening allowing a crossing magnetic flux to pass therethrough, wherein the coil opening is arranged so as to face to a front surface of the insulating substrate.

10. An antenna used for near field communication, comprising:

an insulating substrate in which an antenna is formed into an L shape on a same plane; and an antenna coil formed on the insulating substrate, the antenna coil comprising a first pattern formed into an L shape on a first surface of the insulating substrate and a second pattern formed into an L shape on a second surface of the insulating substrate, the antenna coil being provided with an inlet/outlet port of a crossing magnetic flux on a surface of an outer side of the insulating substrate; and a magnetic sheet that guides the crossing magnetic flux from the surface of the outer side of the insulating substrate, the inlet/outlet port being orthogonal to a plane of the magnetic sheet, wherein the magnetic sheet is arranged between the first pattern of the antenna coil and the second pattern of the antenna coil.

11. The antenna of claim 10, further comprising a coil opening of the antenna coil provided on an antenna surface of the insulating substrate, the coil opening allowing a crossing magnetic flux to pass therethrough, wherein the first pattern formed on the first surface of the insulating substrate includes an inner pattern formed on the antenna surface and wherein the second pattern formed on the second surface of the insulating substrate includes an outer pattern formed on the antenna surface, the inner and outer patterns being opposite to each other about the coil opening, wherein the magnetic sheet located between the first pattern and the second pattern is arranged so as to penetrate the coil opening and so that a first portion of the magnetic sheet overlaps the inner pattern and a second portion of the magnetic sheet overlaps the outer pattern, and wherein the magnetic sheet guides the crossing magnetic flux from the outer side surface of the insulating substrate to the coil opening.

12. The antenna of claim 10, wherein the first pattern formed on the first surface of the insulating substrate includes a front surface pattern formed on a front-side antenna surface of the insulating substrate; and wherein the second pattern formed on the second surface of the insulating substrate includes a back surface pattern formed on a back-side antenna surface of the insulating substrate and connecting to the front surface pattern at an end portion of the back surface pattern.

13. A portable electronic instrument, comprising:

a chassis that includes a side surface, a front surface and a back surface and defines a touch corner for performing a touch operation at a corner of the side surface;

an antenna including:

an insulating substrate provided with a bent portion that is bent at a predetermined angle fitted to the corner of the side surface on a same plane, an antenna coil formed on the insulating substrate, the antenna coil forming a first pattern formed on a first surface of the insulating substrate and bent at the predetermined angle and a second pattern formed on a second surface of the insulating substrate and bent at the predetermined angle, the antenna coil being provided with an inlet/outlet port of a crossing magnetic flux on an outer surface of the insulating substrate, in which the inlet/outlet port of the crossing magnetic flux is arranged so as to face to the side surface of the chassis, and a magnetic sheet that guides the crossing magnetic flux from the side surface of the chassis, the inlet/outlet port being orthogonal to a plane of the magnetic sheet, wherein the magnetic sheet is located between the first pattern of the antenna coil and the second pattern of the antenna coil, wherein the first pattern is located above the plane of the magnetic sheet and the second pattern is located below the plane of the magnetic sheet; and a semiconductor chip for controlling transmission/reception of a high frequency signal to/from the antenna.

14. The portable electronic instrument of claim 13, wherein the portable electronic instrument is capable of near field communication, the portable electronic instrument further comprising a shock absorbing region formed in a vicinity of the touch corner that absorbs a shock of the touch operation.

15. The portable electronic instrument of claim 13, wherein the antenna surface is arranged in parallel to the front surface of the chassis.

16. The portable electronic instrument of claim 13, wherein the back surface of the chassis is formed of a metal material.

17. The portable electronic instrument of claim 13, further comprising a coil opening of the antenna coil provided on the surface of the outer side of the insulating substrate, the coil opening allowing a crossing magnetic flux to pass therethrough, wherein the coil opening is arranged to face the side surface of the chassis.

18. The portable electronic instrument of claim 13, further comprising:

a coil opening of the antenna coil, the coil opening allowing a crossing magnetic flux to pass therethrough, wherein the coil opening is arranged so as to face to the front surface of the chassis.

19. The portable electronic instrument of claim 13, wherein the portable electronic instrument is a smart phone or a tablet terminal.

20. The portable electronic instrument of claim 13, wherein:

the first pattern formed on the first surface of the insulating substrate includes an inner pattern formed on an antenna surface of the insulating substrate and the second pattern formed on the second surface of the insulating substrate includes an outer pattern formed on the antenna surface of the insulating substrate, the inner and outer patterns being opposite to each other about a coil opening of the antenna coil, wherein the magnetic sheet guides the crossing magnetic flux from the outer side surface of the chassis to the coil opening, and wherein the magnetic sheet located between the first pattern and the second pattern is arranged so as to penetrate the coil opening and so that a first portion of the magnetic sheet overlaps the inner pattern and a second portion of the magnetic sheet overlaps the outer pattern.

* * * * *